US005783378A

United States Patent [19]

Mydlarz et al.

[11] Patent Number: 5,783,378

[45] Date of Patent: Jul. 21, 1998

[54] HIGH CHLORIDE EMULSION THAT CONTAINS A DOPANT AND PEPTIZER COMBINATION THAT INCREASES HIGH DENSITY CONTRAST

[75] Inventors: Jerzy Z. Mydlarz; Jerzy A. Budz, both of Fairport; Eric L. Bell, Webster, all of N.Y.

[73] Assignee: Eastman Kodak Company, Rochester, N.Y.

[21] Appl. No.: 739,980

[22] Filed: Oct. 30, 1996

[51] Int. Cl.[6] ..... G03C 1/09; G03C 1/35

[52] U.S. Cl. ..... 430/567; 430/604; 430/605

[58] Field of Search ..... 430/604, 605, 430/567

[56] References Cited

U.S. PATENT DOCUMENTS

| | | | |
|---|---|---|---|
| 4,713,323 | 12/1987 | Maskasky | 430/569 |
| 4,933,272 | 6/1990 | McDugal et al. | 430/567 |
| 4,945,035 | 7/1990 | Keevert et al. | 430/567 |
| 5,252,451 | 10/1993 | Bell | 430/567 |
| 5,256,530 | 10/1993 | Bell | 430/567 |
| 5,320,938 | 6/1994 | House et al. | 430/567 |
| 5,385,817 | 1/1995 | Bell | 430/567 |
| 5,418,118 | 5/1995 | Edwards et al. | 430/506 |
| 5,474,888 | 12/1995 | Bell | 430/567 |
| 5,480,771 | 1/1996 | Bell | 430/567 |
| 5,500,335 | 3/1996 | Bell | 430/567 |
| 5,547,827 | 8/1996 | Chen et al. | 430/567 |

OTHER PUBLICATIONS

Research Disclosure, vol. 389, Sep., 1996, Item 38957, II. A.

Research Disclosure, Item 38957, I. D.

*Primary Examiner*—Mark F. Huff

*Attorney, Agent, or Firm*—Carl O. Thomas

[57] ABSTRACT

A radiation-sensitive high chloride emulsion is disclosed comprised of grains predominantly bounded by {100} crystal faces and internally containing three dopants each selected to satisfy a different one of the following class requirements: (i) a metal coordination complex containing a nitrosyl or thionitrosyl ligand in combination with a transition metal chosen from groups 5 to 10 inclusive of the periodic table of elements, (ii) a shallow electron trapping dopant, and (iii) an iridium coordination complex having ligands each of which are more electropositive than a cyano ligand. A gelatino-peptizer for the grains is employed that contains less than 30 micromoles of methionine per gram. The dopants and peptizer in combination increase contrast and provide a highly unexpected increase in high density contrast.

18 Claims, No Drawings

HIGH CHLORIDE EMULSION THAT CONTAINS A DOPANT AND PEPTIZER COMBINATION THAT INCREASES HIGH DENSITY CONTRAST

FIELD OF THE INVENTION

This invention is directed to radiation-sensitive silver halide emulsions useful in photography.

DEFINITION OF TERMS

The term "high chloride" in referring to silver halide grains and emulsions indicates that chloride is present in a concentration of greater than 50 mole percent, based on total silver.

In referring to grains and emulsions containing two or more halides, the halides are named in order of ascending concentrations.

All references to the periodic table of elements periods and groups in discussing elements are based on the Periodic Table of Elements as adopted by the American Chemical Society and published in the *Chemical and Engineering News*, Feb. 4, 1985, p. 26. The term "Group VIII" is used to generically describe elements in groups 8, 9 and 10.

The term "central portion" in referring to silver halide grains refers to that portion of the grain structure that is first precipitated accounting for up to 98 percent of total precipitated silver required to form the {100} crystal faces of the grains.

The term "dopant" is employed to indicate any material within the rock salt face centered cubic crystal lattice structure of the central portion of a silver halide grain other than silver ion or halide ion.

The term "surface modifier" refers to any material other than silver ion or halide ion that is associated with a portion of the silver halide grains other than the central portion.

The term "gelatino-peptizer" is employed to designate a gelatin peptizer or a peptizer derived from gelatin, such as acetylated or phthalated gelatin.

The term "low methionine" in referring to gelatino-peptizers indicates a methionine level of less than 30 micromoles per gram.

The term "tabular grain" indicates a grain having two parallel major crystal faces (face which are clearly larger than any remaining crystal face) and having an aspect ratio of at least 2.

The term "aspect ratio" designates the ratio of the average edge length of a major face to grain thickness.

The term "tabular grain emulsion" refers to an emulsion in which tabular grains account for greater than 50 percent of total grain projected area.

The term "{100} tabular" is employed in referring to tabular grains and tabular grain emulsions in which the tabular grains have {100} major faces.

The term "log E" is the logarithm of exposure in lux-seconds.

Speed is referenced to a density of 1.0 and is reported as relative log speed, where 1.0 relative log speed unit is equal to 0.01 log E.

The term "instantaneous contrast" is employed to indicate the slope of a line tangent to the characteristic curve at a selected optical density (D). Instantaneous contrast is also commonly referred to as dD÷dlog E, were d indicates the differential value. *Research Disclosure* is published by Kenneth Mason Publications, Ltd., Dudley House, 12 North St., Emsworth, Hampshire P010 7DQ, England.

BACKGROUND

Maskasky U.S. Pat. No. 4,713,323 employed a low methionine gelatino-peptizer in the preparation of high chloride {111} tabular grain emulsions to reduce tabular grain thickness and eliminate any necessity of employing a synthetic peptizer. House et al U.S. Pat. No. 5,320,938 taught the use of a low methionine gelatino-peptizer as an option in the preparation of high chloride {100} tabular grain emulsions. Treatment of gelatino-peptizer with an oxidizing agent to lower methionine is disclosed by *Research Disclosure*, Vol. 389, September 1996, Item 38957, II. Vehicles, vehicle extenders, vehicle-like addenda and vehicle related addenda, A. Gelatin and hydrophilic colloid peptizers, paragraph (3).

The use of dopants in silver halide grains to modify photographic performance is generally illustrated by *Research Disclosure*, Item 38957, cited above, I. Emulsion grains and their preparation, D. Grain modifying conditions and adjustments, paragraphs (3)–(5). McDugal et al U.S. Pat. No. 4,933,272 was the first to teach the incorporation of hexacoordination complexes containing a transition metal and a nitrosyl or thionitrosyl ligand as a dopant in silver halide grains. Keevert et al U.S. Pat. No. 4,945,035 was the first to teach the incorporation of a hexacoordination complex containing a transition metal and cyano ligands as a dopant in high chloride grains. Maskasky, cited above, which preceded McDugal et al and Keevert et al, and House et al, cited above, which followed McDugal et al and Keevert et al, both contemplated the inclusion of conventional dopants, although no investigations of dopants are reported.

Bell U.S. Pat. Nos. 5,252,451, 5,256,530, 5,385,817, 5,474,888, 5,480,771 and 5,500,335, hereinafter collectively referred to as Bell, investigated the effects of varied combinations of grain dopants and surface modifiers. The reported combinations are summarized in Table I.

TABLE I

| Patent | Surface Modifier | Surface Modifier | Dopant | Dopant |
|---|---|---|---|---|
| '451 | Os(NO)[1] | | M(CN)[2] | |
| '530 | Os(NO) | M(CN) | | |
| '817 | M(CN) | Os(NO) | | |
| '888 | Os(NO) | | M(CN) | Ir[3] |
| '771 | M(CN) | | Os(NO) | Ir |
| '335 | Os(NO) | M(CN) | | Ir |

[1] $Os(NO)Cl_5$
[2] $Fe(CN)_6$ or $Ru(CN)_6$
[3] $Ir(Cl)_6$

What becomes quite clear from the various combinations of Bell is that including all of Os(NO), M(CN) and Ir as dopants was avoided. Bell specifically notes that previous combinations of dopants have been ineffective. As a result, in using these three materials in combination, at least one of the materials was located at the surface of the grains and subject to displacement or competition from other addenda present at the surfaces of the grains.

Edwards et al U.S. Pat. No. 5,418,118 teaches color paper constructions in which instantaneous contrast progressively increases in going from areas of minimum density to areas of maximum density, so that increased detail in shadow areas can be seen.

RELATED PATENT APPLICATION

McIntyre et al U.S. Ser. No. 08/429,989, filed Apr. 27, 1995, commonly assigned and now U.S. Pat. No. 5,597,686, titled PHOTOGRAPHIC SILVER HALIDE CONTAINING CONTRAST IMPROVING DOPANTS, discloses employing Os(NO) and M(CN) dopants in combination to improve contrast by sharpening the toe of the characteristic curve and increasing γ, where γ is measured as the slope of the characteristic curve measure from 0.3 log E short of the speed point to 0.3 log E beyond the speed point, the speed point being taken at a density of 1.0. It is suggested, but not demonstrated, that a third transition metal can be added as a dopant or as a grain growth modifier "without significantly detracting from effects of the other emulsion dopants". In other words, there is no indication that the optional, third transition metal plays any role in obtaining the advantages described. McIntyre et al contains no teaching or suggestion of low methionine gelatino-peptizers.

Mydlarz et al U.S. Ser. No. 08/740,535, concurrently filed and commonly assigned, titled DIGITAL IMAGING WITH HIGH CHLORIDE EMULSIONS, discloses an electronic printing method which comprises subjecting a radiation sensitive silver halide emulsion layer of a recording element to actinic radiation of at least $10^{-4}$ ergs/cm$^2$ for up to 100μ seconds duration in a pixel-by-pixel mode. The silver halide emulsion layer is comprised of grains predominantly bounded by {100} crystal faces and internally containing three dopants each selected to satisfy a different one of the following class requirements: (i) a metal coordination complex containing a nitrosyl or thionitrosyl ligand in combination with a transition metal chosen from groups 5 to 10 inclusive of the periodic table of elements, (ii) a shallow electron trapping dopant, and (iii) an iridium coordination complex having ligands each of which are more electropositive than a cyano ligand. A gelatino-peptizer for the grains is employed that contains less than 30 micromoles of methionine per gram. The dopants and peptizer in combination increase contrast and provide a highly unexpected increase in high density contrast.

SUMMARY OF THE INVENTION

In one aspect this invention is directed to a radiation-sensitive emulsion comprised of (1) silver halide grains (a) containing greater than 50 mole percent chloride, (b) having greater than 50 percent of their surface area of their surface area provided by {100} crystal faces, and (c) having a central portion accounting for from 95 to 98 percent of total silver and containing three dopants each selected to satisfy a different one of the following class requirements: (i) a metal coordination complex containing a nitrosyl or thionitrosyl ligand in combination with a transition metal chosen from groups 5 to 10 inclusive of the periodic table of elements, (ii) a shallow electron trapping dopant, and (iii) an iridium coordination complex having ligands each of which are more electropositive than a cyano ligand, and (2) a gelatino-peptizer for the silver halide grains that contains less than 30 micromoles of methionine per gram.

It has been discovered quite surprisingly that the combination of dopants (i), (ii) and (iii) in further combination with a low methionine gelatino- peptizer provides higher instantaneous contrast over a range of densities. Whereas the dopants (i), (ii) and (iii) when employed in combination in emulsions that contain gelatino-peptizer methionine levels that have not been reduced to low levels do not increase instantaneous contrast at higher densities (e.g., at a density of 2.0), the emulsions of the invention demonstrate markedly increased instantaneous contrast at these higher density levels. In a preferred practical application this can be transformed into color print images showing increased shadow detail.

Furthermore the invention offers the advantage of placing (i), (ii) and (iii) within the central portion of the grains, thereby protecting these materials from competing and/or antagonistic effects that can occur at the surface of the grains as a result of chemical and spectral sensitization and the addition of other adsorbed addenda.

DESCRIPTION OF PREFERRED EMBODIMENTS

Emulsions satisfying the requirements of the invention can be prepared by modifying the preparation of conventional high chloride grains satisfying features (a) and (b) of the summary above by employing in combination dopants from classes (i), (ii) and (iii) and a gelatino-peptizer than contains less than 30 micromoles of methionine per gram.

Although natural sources of gelatin exist that contain less than 30 micromoles of methionine per gram, they are relatively rare. To obtain a peptizer useful in the practice of the invention it is generally necessary to treat a commercially available gelatin with a methionine oxidizing agent. This is disclosed by Maskasky U.S. Pat. No. 4,713,323 and King et al U.S. Pat. No. 4,942,120, the disclosures of which are here incorporated by reference, and by Takada et al EPO 0 434 012 and Okumura et al EPO 0 553 622. Examples of methionine oxidizing agents include NaOCl, chloramine, potassium monopersulfate, hydrogen peroxide and peroxide releasing compounds, ozone, thiosulfates and alkylating agents.

Although the art has established less than 30 micromoles per gram of gelatino-peptizer as the demarcation of low methionine gelatino-peptizers, it is appreciated that, in practice, when a gelatino-peptizer is treated with an oxidizing agent the methionine content is preferably reduced below 12 micromoles per gram and, optimally, below 5 micromoles per gram.

Since very small grains can be held in suspension without a peptizer, peptizer can be added after grain formation has been initiated, but in most instances it is preferred to add at least 10 percent and, most preferably, at least 20 percent, of the peptizer present at the conclusion of precipitation to the reaction vessel before grain formation occurs. The low methionine gelatino-peptizer is preferably the first peptizer to come into contact with the grains. Gelatino-peptizer with higher methionine levels can contact the grains, provided it is maintained below concentration levels sufficient to peptize the grains produced. For instance, any gelatino-peptizer with methionine level of greater than 30 micromoles per gram initially present is preferably held to a concentration of less than 1 percent of the total peptizer employed. While it is should be possible to use another type of peptizer toward the end of precipitation with minimal adverse impact on the emulsions, it is preferred that the low methionine gelatino-peptizer be used as the sole peptizer throughout grain formation and growth.

It is important to note that once grain growth has been completed any conventional vehicle, including gelatin and gelatin derivatives of higher methionine levels can be introduced while still realizing all of the advantages of the invention. Conventional useful vehicle materials and the addenda and modifiers used with them are illustrated by *Research Disclosure*, Item 38957, II. Vehicles, vehicle extenders, vehicle-like addenda and vehicle related addenda.

A class (i) dopant is a metal coordination complex containing a nitrosyl or thionitrosyl ligand in combination with a transition metal chosen from groups 5 to 10 inclusive of the periodic table of elements. In a preferred form class (i) dopant satisfies the formula:

$$[ML_4(NY)L']^n \quad (I)$$

wherein

M is a transition metal chosen from groups 5 to 10 inclusive of the periodic table of elements;

L' is L or (NY);

L is a bridging ligand, which can be independently selected in each occurrence and is anionic in at least four occurrences;

Y is oxygen or sulfur; and n is zero, −1, −2 or −3.

The performance of dopants satisfying formula (I) is derived primarily by the presence of a nitrosyl (NO) and thionitrosyl (NS) ligand, although practically influenced by the transition metal selection. The remaining ligands can be any convenient choice of bridging ligands, including additional nitrosyl and thionitrosyl ligands.

Specific examples of preferred bridging ligands other than nitrosyl and thionitrosyl include aquo ligands, halide ligands (specifically, fluoride, chloride, bromide and iodide), cyano ligands, cyanate ligands, thiocyanate ligands, selenocyanate ligands, tellurocyanate ligands, and azide ligands. The charge neutral ligands, the nitrosyl or thionitrosyl ligands and the aquo ligands, when present, collectively account for no more than two of the ligands. Hexacoordinated transition metal complexes which include in addition to their nitrosyl and thionitrosyl ligands up to five halide and/or cyanide ligands are specifically preferred.

Any transition metal capable of forming a coordination complex can be employed in the practice of the invention. The transition metals of groups 5 to 10 inclusive of the periodic table are known to form tetracoordination and hexacoordination complexes. Preferred transition metals include chromium, rhenium, ruthenium, osmium and iridium, with osmium and ruthenium generally providing optimum performance.

In a specifically preferred form the class (i) dopants satisfy the formula:

$$[M'L''_5(NY)]^n \quad (Ia)$$

wherein

M' represents chromium, rhenium, ruthenium or osmium;

L" represents one or a combination of halide and cyano ligands or a combination of these ligands with an aquo ligand;

Y is oxygen or sulfur; and n is zero, −1, −2 or −3.

In a further preferred from the dopants (i) satisfy the formula:

$$[M''X_5(NY)]^{-2} \quad (Ib)$$

wherein

M" represents osmium or ruthenium;

X represents a chloride or bromide ligand; and

Y is oxygen or sulfur.

When the class (i) dopants have a net negative charge, it is appreciated that they are associated with a counter ion when added to the reaction vessel during precipitation. The counter ion is of little importance, since it is ionically dissociated from the dopant in solution and is not incorporated within the grain. Common counter ions known to be fully compatible with silver chloride precipitation, such as ammonium and alkali metal ions, are contemplated. To avoid repetition, it is noted that the same comments apply to class (ii) and (iii) dopants, otherwise described below.

Listings of specific class (i) dopants, including those satisfying formulae (I), (Ia) and (Ib), are included in McDugal et al, Bell and McIntyre et al, each cited above, and here incorporated by reference.

Class (i) dopant is introduced into the high chloride grains before the addition to the reaction vessel of 95, preferably 75, percent of the silver forming the grains has been completed. Stated in terms of the fully precipitated grain structure, class (i) dopant is present in an interior region accounting for 95, preferably 75, percent of the high chloride grains. If desired, class (i) dopant can be added to the reaction vessel prior to grain nucleation. Alternatively, class (i) dopant can be added in a precipitation band at some intermediate stage of precipitation, or class (i) dopant can be added as precipitation is occurring so that it is distributed through the interior region of the grains.

Class (i) dopant can be employed in any conventional useful concentration. A preferred concentration range is from $10^{-10}$ to $10^{-6}$ mole per silver mole, most preferably from $10^{-9}$ to $10^{-7}$ mole per silver mole.

The following are specific illustrations of class (i) compounds:

| | |
|---|---|
| (i-1) | $[Ru(NO)Cl_5]^{-2}$ |
| (i-2) | $[Ru(NO)Br_5]^{-2}$ |
| (i-3) | $[Ru(NO)I_5]^{-2}$ |
| (i-4) | $[Os(NO)Cl_5]^{-2}$ |
| (i-5) | $[Os(NO)Br_5]^{-2}$ |
| (i-6) | $[Ru(NS)Cl_5]^{-2}$ |
| (i-7) | $[Os(NS)Br_5]^{-2}$ |

The class (ii) dopant is a shallow electron trapping dopant. Using empirical techniques the art has over the years identified many class (ii) dopants capable of increasing photographic speed. Scientific investigations have gradually established that class (ii) dopants share the capability of providing shallow electron trapping sites. Olm et al U.S. Pat. No. 5,503,970 and Daubendiek et al U.S. Pat. No. 5,494,789 and 5,503,971, here incorporated by reference, as well as *Research Disclosure*, Vol. 367, November 1994, Item 36736, were the first to set out comprehensive criteria for a dopant to have the capability of providing shallow electron trapping sites.

When a photon is absorbed by a silver halide grain, an electron (hereinafter referred to as a photoelectron) is promoted from the valence band of the silver halide crystal lattice to its conduction band, creating a hole (hereinafter referred to as a photo-hole) in the valence band. To create a latent image site within the grain, a plurality of photoelectrons produced in a single imagewise exposure must reduce several silver ions in the crystal lattice to form a small cluster of $Ag^o$ atoms. To the extent that photo-electrons are dissipated by competing mechanisms before the latent image can form, the photographic sensitivity of the silver halide grains is reduced. For example, if the photoelectron returns to the photohole, its energy is dissipated without contributing to latent image formation.

It is contemplated to dope the high chloride grains to create within them shallow electron traps that contribute to utilizing photoelectrons for latent image formation with greater efficiency. This is achieved by incorporating in the face centered cubic crystal lattice a dopant that exhibits a net valence more positive than the net valence of the ion or ions it displaces in the crystal lattice. For example, in the simplest possible form the dopant can be a polyvalent (+2 to +5) metal ion that displaces silver ion ($Ag^+$) in the crystal lattice structure. The substitution of a divalent cation, for example, for the monovalent $Ag^+$ cation leaves the crystal lattice with a local net positive charge. This lowers the energy of the conduction band locally. The amount by which the local energy of the conduction band is lowered can be estimated by applying the effective mass approximation as described by J. F. Hamilton in the journal *Advances in Physics*, Vol. 37 (1988) p. 395 and *Excitonic Processes in Solids* by M. Ueta, H. Kansaki, K. Kobayshi, Y. Toyozawa and E. Hanamura (1986), published by Springer-Verlag, Berlin, p. 359. If a silver chloride crystal lattice structure receives a net positive charge of +1 by doping, the energy of its conduction band is lowered in the vicinity of the dopant by about 0.048 electron volts (eV). For a net positive charge of +2 the shift is about 0.192 eV. For a silver bromide crystal lattice structure a net positive charge of +1 imparted by doping lowers the conduction band energy locally by about 0.026 eV. For a net positive charge of +2 the energy is lowered by about 0.104 eV.

When photoelectrons are generated by the absorption of light, they are attracted by the net positive charge at the dopant site and temporarily held (i.e., bound or trapped) at the dopant site with a binding energy that is equal to the local decrease in the conduction band energy. The dopant that causes the localized bending of the conduction band to a lower energy is referred to as a shallow electron trap because the binding energy holding the photoelectron at the dopant site (trap) is insufficient to hold the electron permanently at the dopant site. Nevertheless, shallow electron trapping sites are useful. For example, a large burst of photoelectrons generated by a high intensity exposure can be held briefly in shallow electron traps to protect them against immediate dissipation while still allowing their efficient migration over a period of time to latent image forming sites.

For a dopant to be useful in forming a shallow electron trap it must satisfy additional criteria beyond simply providing a net valence more positive than the net valence of the ion or ions it displaces in the crystal lattice. When a dopant is incorporated into the silver halide crystal lattice, it creates in the vicinity of the dopant new electron energy levels (orbitals) in addition to those energy levels or orbitals which comprised the silver halide valence and conduction bands. For a dopant to be useful as a shallow electron trap it must satisfy these additional criteria: (1) its highest energy electron occupied molecular orbital (HOMO, also commonly referred to as the frontier orbital) must be filled—e.g., if the orbital will hold two electrons (the maximum possible number), it must contain two electrons and not one and (2) its lowest energy unoccupied molecular orbital (LUMO) must be at a higher energy level than the lowest energy level conduction band of the silver halide crystal lattice. If conditions (1) and/or (2) are not satisfied, there will be a local, dopant-derived orbital in the crystal lattice (either an unfilled HOMO or a LUMO) at a lower energy than the local, dopant-induced conduction band minimum energy, and photoelectrons will preferentially be held at this lower energy site and thus impede the efficient migration of photoelectrons to latent image forming sites.

Metal ions satisfying criteria (1) and (2) are the following: Group 2 metal ions with a valence of +2, Group 3 metal ions with a valence of +3 but excluding the rare earth elements 58–71, which do not satisfy criterion (1), Group 12 metal ions with a valence of +2 (but excluding Hg, which is a strong desensitizer, possibly because of spontaneous reversion to $Hg^{+1}$), Group 13 metal ions with a valence of +3, Group 14 metal ions with a valence of +2 or +4 and Group 15 metal ions with a valence of +3 or +5. Of the metal ions satisfying criteria (1) and (2) those preferred on the basis of practical convenience for incorporation as dopants include the following period 4, 5 and 6 elements: lanthanum, zinc, cadmium, gallium, indium, thallium, germanium, tin, lead and bismuth. Specifically preferred metal ion dopants satisfying criteria (1) and (2) for use in forming shallow electron traps are zinc, cadmium, indium, lead and bismuth. Specific examples of shallow electron trap dopants of these types are provided by DeWitt, Gilman et al, Atwell et al, Weyde et al and Murakima et al EPO 0 590 674 and 0 563 946, each cited above and here incorporated by reference.

Metal ions in Groups 8, 9 and 10 (hereinafter collectively referred to as Group VIII metal ions) that have their frontier orbitals filled, thereby satisfying criterion (1), have also been investigated. These are Group 8 metal ions with a valence of +2, Group 9 metal ions with a valence of +3 and Group 10 metal ions with a valence of +4. It has been observed that these metal ions are incapable of forming efficient shallow electron traps when incorporated as bare metal ion dopants. This is attributed to the LUMO lying at an energy level below the lowest energy level conduction band of the silver halide crystal lattice.

However, coordination complexes of these Group VIII metal ions as well as $Ga^{+3}$ and $In^{+3}$, when employed as dopants, can form efficient shallow electron traps. The requirement of the frontier orbital of the metal ion being filled satisfies criterion (1). For criterion (2) to be satisfied at least one of the ligands forming the coordination complex must be more strongly electron withdrawing than halide (i.e., more electron withdrawing than a fluoride ion, which is the most highly electron withdrawing halide ion).

One common way of assessing electron withdrawing characteristics is by reference to the spectrochemical series of ligands, derived from the absorption spectra of metal ion complexes in solution, referenced in *Inorganic Chemistry: Principles of Structure and Reactivity*, by James E. Huheey, 1972, Harper and Row, New York and in *Absorption Spectra and Chemical Bonding in Complexes* by C. K. Jorgensen, 1962, Pergamon Press, London. From these references the following order of metal ions in the spectrochemical series is apparent:

$$I^- < BR^- < S^{-2} < \underline{S}CN^- < Cl^- < NO_3^- < F^- < \underline{O}H < ox^{-2} < H_2O < \underline{N}CS^- < CH_3C\underline{N}^- < \underline{N}H_3 < en < dipy < phen < \underline{N}O_2^- < phosph << \underline{C}N^- < \underline{C}O.$$

The abbreviations used are as follows: ox=oxalate, dipy=dipyridine, phen=o-phenathroline, and phosph=4-methyl-2,6,7-trioxa-1-phosphabicyclo[2.2.2]octane. The spectrochemical series places the ligands in sequence in their electron withdrawing properties, the first ($I^-$) ligand in the series is the least electron withdrawing and the last (CO) ligand being the most electron withdrawing. The underlining indicates the site of ligand bonding to the polyvalent metal ion. The efficiency of a ligand in raising the LUMO value of the dopant complex increases as the ligand atom bound to the metal changes from Cl to S to O to N to C. Thus, the ligands $\underline{C}N^-$ and $\underline{C}O$ are especially preferred. Other preferred ligands are thiocyanate ($\underline{N}CS^-$), selenocyanate ($\underline{N}CSe^-$), cyanate ($\underline{N}CO^-$), tellurocyanate ($\underline{N}CTe^-$) and azide ($N_3^-$).

Just as the spectrochemical series can be applied to ligands of coordination complexes, it can also be applied to the metal ions. The following spectrochemical series of metal ions is reported in *Absorption Spectra and Chemical Bonding* by C. K. Jorgensen, 1962, Pergamon Press, London:

$$Mn^{+2} < Ni^{+2} < Co^{+2} < Fe^{+2} < Cr^{+3} >> V^{+3} < Co^{+3} < Mn^{+4} < Mo^{+3} < Rh^{+3} >> Ru^{+3} < Pd^{+4} < Ir^{+3} < Pt^{+4}$$

The metal ions in boldface type satisfy frontier orbital requirement (1) above. Although this listing does not contain all the metals ions which are specifically contemplated for use in coordination complexes as dopants, the position of the remaining metals in the spectrochemical series can be identified by noting that an ion's position in the series shifts from $Mn^{+2}$, the least electronegative metal, toward $Pt^{+4}$, the most electronegative metal, as the ion's place in the Periodic Table of Elements increases from period 4 to period 5 to period 6. The series position also shifts in the same direction when the positive charge increases. Thus, $Os^{+3}$, a period 6 ion, is more electronegative than $Pd^{+4}$, the most electronegative period 5 ion, but less electronegative than $Pt^{+4}$, the most electronegative period 6 ion.

From the discussion above $Rh^{+3}$, $Ru^{+3}$, $Pd^{+4}$, $Ir^{+3}$, $Os^{+3}$ and $Pt^{+4}$ are clearly the most electro-negative metal ions satisfying frontier orbital requirement (1) above and are therefore specifically preferred.

To satisfy the LUMO requirements of criterion (2) above the filled frontier orbital polyvalent metal ions of Group VIII are incorporated in a coordination complex containing ligands, at least one, most preferably at least 3, and optimally at least 4 of which are more electronegative than halide, with any remaining ligand or ligands being a halide ligand. When the metal ion is itself highly electronegative, such $Os^{+3}$, only a single strongly electronegative ligand, such as carbonyl, for example, is required to satisfy LUMO requirements. If the metal ion is itself of relatively low electronegativity, such as $Fe^{+2}$, choosing all of the ligands to be highly electronegative may be required to satisfy LUMO requirements. For example, Fe(II) $(CN)_6$ is a specifically preferred shallow electron trapping dopant. In fact, coordination complexes containing 6 cyano ligands in general represent a convenient, preferred class of shallow electron trapping dopants.

Since $Ga^{+3}$ and $In^{+3}$ are capable of satisfying HOMO and LUMO requirements as bare metal ions, when they are incorporated in coordination complexes they can contain ligands that range in electronegativity from halide ions to any of the more electronegative ligands useful with Group VIII metal ion coordination complexes.

For Group VIII metal ions and ligands of intermediate levels of electronegativity it can be readily determined whether a particular metal coordination complex contains the proper combination of metal and ligand electronegativity to satisfy LUMO requirements and hence act as a shallow electron trap. This can be done by employing electron paramagnetic resonance (EPR) spectroscopy. This analytical technique is widely used as an analytical method and is described in *Electron Spin Resonance: A Comprehensive Treatise on Experimental Techniques*, 2nd Ed., by Charles P. Poole, Jr. (1983) published by John Wiley & Sons, Inc., New York.

Photoelectrons in shallow electron traps give rise to an EPR signal very similar to that observed for photoelectrons in the conduction band energy levels of the silver halide crystal lattice. EPR signals from either shallow trapped electrons or conduction band electrons are referred to as electron EPR signals. Electron EPR signals are commonly characterized by a parameter called the g factor. The method for calculating the g factor of an EPR signal is given by C. P. Poole, cited above. The g factor of the electron EPR signal in the silver halide crystal lattice depends on the type of halide ion(s) in the vicinity of the electron. Thus, as reported by R. S. Eachus, M. T. Olm, R. Janes and M. C. R. Symons in the journal *Physica Status Solidi* (b), Vol. 152 (1989), pp. 583–592, in a AgCl crystal the g factor of the electron EPR signal is 1.88±0.001 and in AgBr it is 1.49±0.02.

A coordination complex dopant can be identified as useful in forming shallow electron traps in the practice of the invention if, in the test emulsion set out below, it enhances the magnitude of the electron EPR signal by at least 20 percent compared to the corresponding undoped control emulsion. The undoped control emulsion is a 0.45±0.05 μm edge length AgBr octahedral emulsion precipitated, but not subsequently sensitized, as described for Control 1A of Marchetti et al U.S. Pat. No. 4,937,180. The test emulsion is identically prepared, except that the metal coordination complex in the concentration intended to be used in the emulsion of the invention is substituted for $Os(CN_6)^{4-}$ in Example 1B of Marchetti et al.

After precipitation, the test and control emulsions are each prepared for electron EPR signal measurement by first centrifuging the liquid emulsion, removing the supernatant, replacing the supernatant with an equivalent amount of warm distilled water and resuspending the emulsion. This procedure is repeated three times, and, after the final centrifuge step, the resulting powder is air dried. These procedures are performed under safe light conditions.

The EPR test is run by cooling three different samples of each emulsion to 20, 40 and 60° K., respectively, exposing each sample to the filtered output of a 200 W Hg lamp at a wavelength of 365 nm, and measuring the EPR electron signal during exposure. If, at any of the selected observation temperatures, the intensity of the electron EPR signal is significantly enhanced (i.e., measurably increased above signal noise) in the doped test emulsion sample relative to the undoped control emulsion, the dopant is a shallow electron trap.

As a specific example of a test conducted as described above, when a commonly used shallow electron trapping dopant, Fe(CN) $6^{4-}$, was added during precipitation at a molar concentration of $50\times10^{-6}$ dopant per silver mole as described above, the electron EPR signal intensity was enhanced by a factor of 8 over undoped control emulsion when examined at 20° K.

In a preferred form the class (ii) dopants contemplated for use in the practice of this invention are hexacoordination complexes. They contain a metal ion and six ligands that displace a silver ion and six adjacent halide ions in the crystal lattice. One or two of the coordination sites can be occupied by neutral ligands, such as carbonyl, aquo or amine ligands, but the remainder of the ligands are anionic to facilitate efficient incorporation of the coordination complex in the crystal lattice structure.

Illustrations of specifically contemplated class (ii) hexacoordination complexes for inclusion in the high chloride grains are provided by Bell, cited above, Olm et al U.S. Pat. No. 5,503,970 and Daubendiek et al U.S. Pat. Nos. 5,494,789 and 5,503,971, and Keevert et al U.S. Pat. No. 4,945,035, the disclosures of which are here incorporated by reference, as well as Murakami et al Japanese Patent Application Hei-2[1990]-249588, and *Research Disclosure* Item 36736, the disclosures of which are here incorporated by reference. Useful neutral and anionic organic ligands for class (ii) dopant hexacoordination complexes are disclosed by Olm et al U.S. Pat. No. 5,360,712 and Kuromoto et al U.S. Pat. No. 5,462,849, the disclosures of which are here incorporated by reference.

In a specific, preferred form it is contemplated to employ as a class (ii) shallow electron trapping dopant a hexacoordination complex satisfying the formula:

$$[ML_6]^n \qquad \text{(II)}$$

where

M is filled frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$ or $Pt^{+4}$;

$L_6$ represents six bridging ligands which can be independently selected, provided that least four of the ligands are anionic ligands and at least one (preferably at least 3 and optimally at least 4) of the ligands is a cyano ligand or a ligand more electronegative than a cyano ligand. Any remaining ligands can be selected from among various other bridging ligands described above other than nitrosyl or thionitrosyl ligands. In a specifically preferred form any remaining ligand is a halide ligand.

Class (ii) dopant is preferably introduced into the high chloride grains after at least 50 (most preferably 75 and optimally 80) percent of the silver has been precipitated, but has been precipitated, but before precipitation of the central portion of the grains has been completed. Preferably class (ii) dopant is introduced before 98 (most preferably 95 and optimally 90) percent of the silver has been precipitated. Stated in terms of the fully precipitated grain structure, class (ii) dopant is preferably present in an interior shell region that surrounds at least 50 (most preferably 75 and optimally 80) percent of the silver and, with the more centrally located silver, accounts the entire central portion (98 percent of the silver), most preferably accounts for 95 percent, and optimally accounts for 90 percent of the silver halide forming the high chloride grains. The class (ii) dopant can be distributed throughout the interior shell region delimited above or can be added as one or more bands within the interior shell region.

Class (ii) dopant can be employed in any conventional useful concentration. A preferred concentration range is from $10^{-8}$ to $10^{-3}$ mole per silver mole, most preferably from $10^{-6}$ to $5\times10^{-4}$ mole per silver mole.

The following are specific illustrations of class (ii) dopants:

| | |
|---|---|
| (ii-1) | $[Fe(CN)_6]^{-4}$ |
| (ii-2) | $[Ru(CN)_6]^{-4}$ |
| (ii-3) | $[Os(CN)_6]^{-4}$ |
| (ii-4) | $[Rh(CN)_6]^{-3}$ |
| (ii-5) | $[Ir(CN)_6]^{-3}$ |
| (ii-6) | $[Fe(pyrazine)\ (CN)_5]^{-4}$ |
| (ii-7) | $[RuCl(CN)_5]^{-4}$ |
| (ii-8) | $[OsBr(CN)_5]^{-4}$ |
| (ii-9) | $[RhF(CN)_5]^{-3}$ |
| (ii-10) | $[IrBr(CN)_5]^{-3}$ |
| (ii-11) | $[FeCO(CN)_5]^{-4}$ |
| (ii-12) | $[RuF_2(CN)_4]^{-4}$ |
| (ii-13) | $[OsCl_2(CN)_4]^{-4}$ |
| (ii-14) | $[RhI_2(CN)_4]^{-3}$ |
| (ii-15) | $[IrBr_2(CN)_4]^{-3}$ |
| (ii-16) | $[Ru(CN)_4(OCN)]^{-4}$ |
| (ii-17) | $[Ru(CN)_5(N_3)]^{-4}$ |
| (ii-18) | $[Os(CN)_5(SCN)]^{-4}$ |
| (ii-19) | $[Rh(CN)_5(SeCN)]^{-3}$ |
| (ii-20) | $[Ir(CN)_5(HOH)]^{-2}$ |
| (ii-21) | $[Fe(CN)_3Cl_3]^{-3}$ |
| (ii-22) | $[Ru(CO)_2(CN)_4]^{-1}$ |
| (ii-23) | $[Os(CN)Cl_5]^{-4}$ |
| (ii-24) | $[Co(CN)_6]^{-3}$ |
| (ii-25) | $[IrCl_4(oxalate)]^{-4}$ |
| (ii-26) | $[In(NCS)_6]^{-3}$ |
| (ii-27) | $[Ga(NCS)_6]^{-3}$ |

Careful scientific investigations have revealed Group VIII hexahalo coordination complexes to create deep electron traps, as illustrated R. S. Eachus, R. E. Graves and M. T. Olm *J. Chem. Phys.*, Vol. 69, pp. 4580–7 (1978) and *Physica Status Solidi A*, Vol. 57, 429–37 (1980) and R. S. Eachus and M. T. Olm *Annu. Rep. Prog. Chem. Sect. C. Phys. Chem.*, Vol. 83, 3, pp. 3–48 (1986).

Class (iii) dopants employed in the practice of this invention are believed to create deep electron traps. The class (iii) dopant is an iridium coordination complex not satisfying class (i) or (ii) requirements.

The class (iii) dopant is an iridium coordination complex having ligands each of which are more electropositive than a cyano ligand. In a specifically preferred form the ligands of the coordination complexes forming class (iii) dopants are halide ligands. Although it has been known and reported for many years that simple salts of rhodium and iridium can be used for doping, mechanistic investigations indicate that the metal ions form coordination complexes with halide ion in solution before incorporation within the crystal lattice structure of the grains occurs. This invention includes as class (iii) dopants iridium ions added as metal ions.

Although halide and other anionic ligands facilitate incorporation of iridium ions in the crystal lattice structure of the high chloride grains, it is the metal ions themselves that provide deep electron trapping sites. Thus, in choosing ligands for the coordination complexes of class (iii) dopants the object is primarily to avoid any ligand that will unduly limit the electron trapping capability of the rhodium or iridium ions. Thus, the nitrosyl or thionitrosyl ligands of class (i) dopants are excluded as well as the cyano and at least equally strongly electron withdrawing ligands present in class (ii) dopants. Any of the remaining ligands listed above as optional ligands for class (i) and (ii) dopants can be selected. It is specifically contemplated to select class (iii) dopants from among the coordination complexes containing organic ligands disclosed by Olm et al U.S. Pat. No. 5,360,712 and Kuromoto et al U.S. Pat. No. 5,360,712, the disclosures of which are here incorporated by reference.

The class (iii) iridium dopants are illustrated by Bell U.S. Pat. Nos. 5,474,888, 5,470,771 and 5,500,335 and McIntyre et al , each cited above and here incorporated by reference.

In a preferred form it is contemplated to employ as a class (iii) dopant a hexacoordination complex satisfying the formula:

$$[IrL_6]^n \qquad \text{(III)}$$

where n is zero, −1, −2, −3 or −4 and $L_6$ represents six bridging ligands, which can be independently selected, provided that least four of the ligands are anionic ligands and each of the ligands is more electropositive than a cyano ligand. In a specifically preferred form the ligands are halide ligands, such as chloride or bromide ligands.

Class (iii) dopant is preferably introduced into the high chloride grains after at least 50 (most preferably 85 and optimally 90) percent of the silver has been precipitated, but before precipitation of the central portion of the grains has been completed. Preferably class (iii) dopant is introduced before 98 (most preferably 97 and optimally 95) percent of the silver has been precipitated. Stated in terms of the fully precipitated grain structure, class (iii) dopant is preferably present in an interior shell region that surrounds at least 50 (most preferably 85 and optimally 90) percent of the silver and, with the more centrally located silver, accounts the entire central portion (98 percent of the silver), most preferably accounts for 97 percent, and optimally accounts for 95 percent of the silver halide forming the high chloride grains. The class (iii) dopant can be distributed throughout the interior shell region delimited above or can be added as one or more bands within the interior shell region.

Class (iii) dopant can be employed in any conventional useful concentration. A preferred concentration range is from $10^{-9}$ to $10^{-5}$ mole per silver mole. Iridium is most preferably employed in a concentration range of from $10^{-8}$ to $10^{-5}$ mole per silver mole.

Specific illustrations of class (iii) dopants are the following:

| | |
|---|---|
| (iii-1) | $[IrCl_6]^{-3}$ |
| (iii-2) | $[IrBr_6]^{-3}$ |
| (iii-3) | $[IrCl_4(en)_2]^{-1}$ |
| (iii-4) | $[IrCl_4(MeSCH_2CH_2SMe)]^{-1}$ |
| (iii-5) | $[IrCl_5(psz)]^{-2}$ |
| (iii-6) | $[IrCl_4(pyz)_2]^{-1}$ |
| (iii-7) | $[IrCl_5(Cl\text{-}pyz)]^{-1}$ |
| (iii-8) | $[IrCl_5(N\text{—}Me\text{-}pyzm)]^{-1}$ |
| (iii-9) | $[IrCl_5(pym)]^{-2}$ |
| (iii-10) | $[IrCl_5(py)]^{-1}$ |
| (iii-11) | $[IrCl_4(py)_2]^{-2}$ |
| (iii-12) | $[IrCl_4(C_2O_4)_2]^{-3}$ |
| (iii-13) | $[IrCl_5(th)]^{-2}$ |
| (iii-14) | $[IrCl_5(Me\text{-}th)]^{-2}$ |

en=enthlenediamine
Me=methyl
py=pyridine
pym=pyrimidine
pyz=pyrazine
pyzm=pyrazinium
th=thiazole Emulsions demonstrating the advantages of the invention can be realized by modifying the precipitation of conventional high chloride silver halide grains having predominantly (>50%) (100) crystal faces by employing a combination of a low methionine gelatino-peptizer and class (i), (ii) and (iii) dopants as described above.

The silver halide grains precipitated contain greater than 50 mole percent chloride, based on silver. Preferably the grains contain at least 70 mole percent chloride and, optimally at least 90 mole percent chloride, based on silver. Iodide can be present in the grains up to its solubility limit, which is in silver iodochloride grains, under typical conditions of precipitation, about 11 mole percent, based on silver. It is preferred for most photographic applications to limit iodide to less than 5 mole percent iodide, most preferably less than 2 mole percent iodide, based on silver.

Silver bromide and silver chloride are miscible in all proportions. Hence, any portion, up to 50 mole percent, of the total halide not accounted for chloride and iodide, can be bromide. For color reflection print (i.e., color paper) uses bromide is typically limited to less than 10 mole percent based on silver and iodide is limited to less than 1 mole percent based on silver.

In a widely used form high chloride grains are precipitated to form cubic grains—that is, grains having {100} major faces and edges of equal length. In practice ripening effects usually round the edges and corners of the grains to some extent. However, except under extreme ripening conditions substantially more than 50 percent of total grain surface area is accounted for by {100} crystal faces.

High chloride tetradecahedral grains are a common variant of cubic grains. These grains contain 6 {100} crystal faces and 8 {111} crystal faces. Tetradecahedral grains are within the contemplation of this invention to the extent that greater than 50 percent of total surface area is accounted for by {100} crystal faces.

Although it is common practice to avoid or minimize the incorporation of iodide into high chloride grains employed in color paper, it is has been recently observed that silver iodochloride grains with {100} crystal faces and, in some instances, one or more {111} faces offer exceptional levels of photographic speed. In the these emulsions iodide is incorporated in overall concentrations of from 0.05 to 3.0 mole percent, based on silver, with the grains having a surface shell of greater than 50 Å that is substantially free of iodide and a interior shell having a maximum iodide concentration that surrounds a core accounting for at least 50 percent of total silver. Such grain structures are illustrated by Chen et al EPO 0 718 679.

In another improved form the high chloride grains can take the form of tabular grains having {100} major faces. Preferred high chloride {100} tabular grain emulsions are those in which the tabular grains account for at least 70 (most preferably at least 90) percent of total grain projected area. Preferred high chloride {100} tabular grain emulsions have average aspect ratios of at least 5 (most preferably at least >8). Tabular grains typically have thicknesses of less than 0.3 μm, preferably less than 0.2 μm, and optimally less than 0.07 μm. High chloride {100} tabular grain emulsions and their preparation are disclosed by Maskasky U.S. Pat. Nos. 5,264,337 and 5,292,632, House et al U.S. Pat. No. 5,320,938, Brust et al U.S. Pat. No. 5,314,798 and Chang et al U.S. Pat. 5,413,904, the disclosures of which are here incorporated by reference.

Once high chloride grains having predominantly {100} crystal faces have been precipitated employing low methionine gelatino-peptizer and the combination of class (i), (ii) and (iii) dopants described above, chemical and spectral sensitization, followed by the addition of conventional addenda to adapt the emulsion for the imaging application of choice can take any convenient conventional form. These conventional features are illustrated by *Research Disclosure*, Item 38957, cited above, particularly:

III. Emulsion washing;
IV. Chemical sensitization;
V. Spectral sensitization and desensitization;
VII. Antifoggants and stabilizers;
VIII. Absorbing and scattering materials;
IX. Coating and physical property modifying addenda; and
X. Dye image formers and modifiers.

As pointed out by Bell, cited above, some additional silver halide, typically less than 1 percent, based on total silver, can be introduced to facilitate chemical sensitization. It is also recognized that silver halide can be epitaxially deposited at selected sites on a host grain to increase its sensitivity. For example, high chloride {100} tabular grains with corner epitaxy are illustrated by Maskasky U.S. Pat. No. 5,275,930. For the purpose of providing a clear demarcation, the term "silver halide grain" is herein employed to include the silver necessary to form the grain up to the point that the final {100} crystal faces of the grain are formed. Silver halide later deposited that does not overlie the {100} crystal faces previously formed accounting for at least 50 percent of the grain surface area is excluded in determining total silver forming the silver halide grains. Thus, the silver forming selected site epitaxy is not part of the silver halide grains while silver halide that deposits and provides the final {100} crystal faces of the grains is included in the total silver forming the grains, even when it differs significantly in composition from the previously precipitated silver halide.

The high chloride emulsions of this invention can be used simply by replacing one or more of the high chloride emulsions in conventional photographic elements.

EXAMPLES

The invention can be better appreciated by reference to the following specific embodiments. The term "non-oxidized gelatin" is used to indicate gelatin that was not treated with an oxidizing agent to reduce its methionine content and that had a naturally occurring methionine content of about 50 micrograms per gram. The term "oxidized gelatin" is used to indicate gelatin that had been treated with a strong oxidizing agent to reduce its methionine content to less than 5 micrograms per gram.

Example Series I

Emulsion Z1

A reaction vessel containing 7.0 L of a solution that was 3% by weight in non-oxidized gelatin, and 112.5 grams in 1,8-dihydroxy-3,6-dithiaoctane was adjusted to 460° C., and a pCl of 1.5. To this stirred solution at 460° C. was added simultaneously and at a constant flow rate of 0.05 moles/min each of 2.8 M $AgNO_3$ and 3.0M NaCl solution.

The resulting emulsion was a cubic grain silver chloride emulsion of 0.4 μm in edgelength size. The emulsion was then washed using an ultrafiltration unit, and its final pH and pCl were adjusted to 5.6 and 1.8, respectively.

Emulsion Z2

This emulsion was precipitated exactly as Emulsion Z1, except that 3 micrograms per silver mole of $Cs_2Os(NO)Cl_5$ were added during precipitation during 0 to 93% of grain formation (percentages correspond to percent of total silver added). Emulsion Z3

This emulsion was precipitated exactly as Emulsion Z1, except that 8.4 milligrams per silver mole of $K_4Fe(CN)_6.3(H_2O)$ were added during precipitation during 0 to 93% of grain formation.

Emulsion Z4

This emulsion was precipitated exactly as Emulsion Z1, except that 3 micrograms per silver mole of $Cs_2Os(NO)Cl_5$ and 8.4 milligrams per silver mole of $K_4Fe(CN)_6.(H2O)$ were each added during precipitation during 0 to 93% of grain formation.

Emulsion Z5

This emulsion was precipitated exactly as Emulsion Z1, except that 0.04 milligram per silver mole of $K_2IrCl_6$ was added during precipitation during 93 to 95% of grain formation.

Emulsion Z6

This emulsion was precipitated exactly as Emulsion Z1, except that 3 micrograms per silver mole of $Cs_2Os(NO)Cl_5$ were added during precipitation during 0 to 93% of grain formation and 0.04 milligrams per silver mole of $K_2IrCl_6$ was added during precipitation during 93 to 95% of grain formation.

Emulsion Z7

This emulsion was precipitated exactly as Emulsion Z1, except that 8.4 milligrams per silver mole of $K_4Fe(CN)_6.3(H_2O)$ were added during precipitation during 0 to 93% of grain formation and 0.04 milligrams per silver mole of $K_2IrCl_6$ was added during precipitation during 93 to 95% of grain formation.

Emulsion Z8

This emulsion was precipitated exactly as Emulsion Z1, except that 3 micrograms per silver mole of $Cs_2Os(NO)Cl_5$ and 8.4 milligrams per silver mole of $K_4Fe(CN)_6(H2O)$ were each added during precipitation during 0 to 93% of grain formation and 0.04 milligrams per silver mole of $K_2IrCl_6$ was added during precipitation during 93 to 95% of grain formation.

Sensitometry

Emulsions Z1 through Z8 were sensitized as follows: A portion of silver chloride emulsion was melted at 40° C. and 17.8 milligrams per silver mole of a gold sensitizing compound as disclosed in Damschroder et al U.S. Pat. No. 2,642,361 added. Then the emulsion was heated to 65° C. and ripened. In addition, 297 milligrams per silver mole of 1-(3-acetamidophenyl)-5-mercaptotetrazole and 1306 milligrams per silver mole of potassium bromide were added along with 20 milligrams per silver mole of the red sensitizing dye D-1, anhydro-3-ethyl-9,11-neopentylene-3'-(3-sulfopropyl)thiadiacarbocyanine hydroxide.

All emulsions were coated at 1.83 mg silver per square decimeter on resin-coated paper support. The coatings were overcoated with a gelatin layer and the entire coating was hardened with bis(vinylsulfonylmethyl)ether.

Coatings were exposed through a step tablet for 0.1 second to a 3000° K. light source with a Wratten™ WR12 filter, which transmits at wavelengths longer than 520 nm, and processed for 45 seconds in a Kodak Ektacolor™ RA-4 developer. After processing, the Status A reflection densities of each coating were measured. Contrast of the lower scale portion of the characteristic curve, 0.3Toe Density, was measured at a point on the characteristic curve 0.3 LogE fast of the speed point (1.0 density). A lower 0.3Toe Density indicates higher contrast.

TABLE II

| Emul. | Gel type | (i) Os | (ii) Fe | (iii) Ir | RLS** | 0.3 Toe Density | % Toe Change |
|---|---|---|---|---|---|---|---|
| Z1 | N/Ox* | — | — | — | 100 | 0.352 | — |
| Z2 | " | x | — | — | 95 | 0.305 | −13.4 |
| Z3 | " | — | x | — | 105 | 0.375 | +6.5 |
| Z4 | " | x | x | — | 91 | 0.249 | −29.3 |
| Z5 | " | — | — | x | 92 | 0.323 | — |
| Z6 | " | x | — | x | 83 | 0.301 | −6.8 |
| Z7 | " | — | x | x | 98 | 0.342 | +5.9 |
| Z8 | " | x | x | x | 75 | 0.304 | −5.9 |

*N/Ox = non-oxidized gelatin
**RLS = relative log speed measured at a density of 1.0.

A comparison of the sensitized results of Emulsions Z1 through Z4 in Table I illustrates the contrast increasing synergy from codoping with $Cs_2Os(NO)Cl_5$ and $K_4Fe(CN)_6.3(H_2O)$ in the absence of $K_2IrCl_6$. The predicted effect on Toe Density from the single doping results (−13.4% for osmium and +6.5% for iron) is only a 6.9% decrease, whereas the actual (Emulsion Z4) decrease is, unexpectedly, 29.3%. A comparison of Emulsions Z5 through Z8 in Table I indicates that no such synergy is present when the emulsion is also doped with iridium during the recipitation. In addition, the triple doped emulsion is significantly desensitized compared to the others. This is one illustration of the problem to be solved.

Example Series 2

Emulsion A

A reaction vessel was provided that initially contained 5.0 L of a solution that was 8% in non-oxidized gelatin, 7.5 grams in NaCl and 0.25 mL of Nalco 2341™ antifoaming agent. The contents of the reaction vessel were maintained at 55° C., and the pCl was adjusted to 1.5. To this stirred solution at 55° C. were added simultaneously and at 18 mL/min each 4.0M $AgNO_3$ and 4.0M NaCl solutions over 1 minute. The silver nitrate solution contained $3\times10^{-6}$ mole of mercuric chloride per mole of silver. Then these solutions were added at ramped flow from 18 to 80 mL/min over 20 minutes, followed by constant rate addition at 80 mL/min over 40 minutes. Then the emulsion was cooled down to 43° C. over 8 minutes.

The resulting emulsion was a cubic grain silver chloride emulsion of 0.4 μm in edgelength size. The emulsion was then washed using an ultrafiltration unit, and its final pH and pCl were adjusted to 5.6 and 1.8, respectively.

Emulsion B

This emulsion was precipitated exactly as Emulsion A, except that 10 micrograms per silver mole of $Cs_2Os(NO)Cl_5$ were added during precipitation during 0 to 75% of grain formation.

Emulsion C

This emulsion was precipitated exactly as Emulsion A, except that 25 milligrams per silver mole of $K_4Ru(CN)_6$ were added during precipitation during 80 to 85% of grain formation.

Emulsion D

This emulsion was precipitated exactly as Emulsion A, except that 10 micrograms per silver mole of $Cs_2Os(NO)Cl_5$ were added during precipitation during 0 to 75% of grain formation and 25 milligrams per silver mole of $K_4Ru(CN)_6$ were added during precipitation during 80 to 85% of grain formation.

Emulsion E

This emulsion was precipitated exactly as Emulsion A, except that 0.04 milligram per silver mole of $K_2IrCl_6$ was added during precipitation during 93 to 95% of grain formation.

Emulsion F

This emulsion was precipitated exactly as Emulsion A, except that 10 micrograms per silver mole of $Cs_2Os(NO)Cl_5$ were added during precipitation during 0 to 75% of grain formation and 0.04 milligrams per silver mole of $K_2IrCl_6$ was added during precipitation during 93 to 95% of grain formation.

Emulsion G

This emulsion was precipitated exactly as Emulsion A, except that 25 milligrams per silver mole of $K_4Ru(CN)_6$ were added during precipitation during 80 to 85% of grain formation and 0.04 milligram per silver mole of $K_2IrCl_6$ was added during precipitation during 93 to 95% of grain formation.

Emulsion H

This emulsion was precipitated exactly as Emulsion A, except that 10 micrograms per silver mole of $Cs_2Os(NO)Cl_5$ were added during precipitation during 0 to 75% of grain formation and 25 milligrams per silver mole of $K_4Ru(CN)_6$ were added during precipitation during 80 to 85% of grain formation and 0.04 milligram per silver mole of $K_2IrCl_6$ was added during precipitation during 93 to 95% of grain formation.

Emulsion I

A reaction vessel was provided that initially contained 5.0 L of a solution that was 8% in oxidized gelatin, 7.5 grams in NaCl and 0.25 mL of Nalco 2341™ antifoaming agent. The contents of the reaction vessel were maintained at 55° C., and the pCl was adjusted to 1.5. To this stirred solution at 55° C. was added simultaneously and at 18 mL/min each 4.0M $AgNO_3$ and 4.0M NaCl solutions over 1 minute. The silver nitrate solution contained $3\times10^{-6}$ mole of mercuric chloride per mole of silver. Then these solutions were added at ramped flow from 18 to 80 mL/min over 20 minutes, followed by constant rate addition at 80 mL/min over 40 minutes. Then the emulsion was cooled down to 43° C. over 8 minutes.

The resulting emulsion was a cubic grain silver chloride emulsion of 0.4 μm in edgelength size. The emulsion was then washed using an ultrafiltration unit, and its final pH and pCl were adjusted to 5.6 and 1.8, respectively.

Emulsion J

This emulsion was precipitated exactly as Emulsion I, except that 10 micrograms per silver mole of $Cs_2Os(NO)Cl_5$ were added during precipitation during 0 to 75% of grain formation.

Emulsion K

This emulsion was precipitated exactly as Emulsion I, except that 25 milligrams per silver mole of $K_4Ru(CN)_6$ were added during precipitation during 80 to 85% of grain formation.

Emulsion L

This emulsion was precipitated exactly as Emulsion I, except that 10 micrograms per silver mole of were added during precipitation during 0 to 75% of grain formation and 25 milligrams per silver mole of $K_4Ru(CN)_6$ were added during precipitation during 80 to 85% of grain formation.

Emulsion M

This emulsion was precipitated exactly as Emulsion I, except that 0.04 milligram per silver mole of $K_2IrCl_6$ was added during precipitation during 93 to 95% of grain formation.

Emulsion N

This emulsion was precipitated exactly as Emulsion I, except that 10 micrograms per silver mole of $Cs_2Os(NO)Cl_5$ were added during precipitation during 0 to 75% of grain formation and 0.04 milligram per silver mole of $K_2IrCl_6$ was added during precipitation during 93 to 95% of grain formation.

Emulsion O

This emulsion was precipitated exactly as Emulsion I, except that 25 milligrams per silver mole of $K_4Ru(CN)_6$ were added during precipitation during 80 to 85% of grain formation and 0.04 milligram per silver mole of $K_2IrCl_6$ was added during precipitation during 93 to 95% of grain formation.

Emulsion P

This emulsion was precipitated exactly as Emulsion I, except that 10 micrograms per silver mole of $Cs_2Os(NO)Cl_5$ were added during precipitation during 0 to 75% of grain formation and 25 milligrams per silver mole of $K_4Ru(CN)_6$ were added during precipitation during 80 to 85% of grain formation and 0.04 milligram per silver mole of $K_2IrCl_6$ was added during precipitation during 93 to 95% of grain formation.

Sensitometry

Emulsions A through P were sensitized as follows: A portion of silver chloride emulsion was melted at 40° C. and the supersensitizing compound 4,4'-[6-(2-chloroanilino)-4-chloro-1,3,5-triazin-2-yl]aminostilbene 2,2'-sulfonic acid, disodium salt was added followed by the addition of an optimum amount of colloidal gold-sulfide. Then the emulsion was heated to 65° C. and ripened for 40 minutes. After cooling down to 40° C., 1-(3-acetamido-phenyl)-5-mercaptotetrazole was added followed by the addition of potassium bromide and red sensitizing dye D-1.

All emulsions were coated at 1.83 mg silver per square decimeter on resin-coated paper support. The coatings were overcoated with a gelatin layer and the entire coating was hardened with bis(vinylsulfonylmethyl)ether.

Coatings were exposed through a step tablet for 0.1 second to a 3000° K. light source with a Wratten™ WR12 filter, which transmits at wavelengths longer than 520 nm, and processed for 45 seconds in a Kodak Ektacolor™ RA-4 developer. After processing, the Status A reflection densities of each coating were measured. Contrast of the lower scale portion of the characteristic curve, 0.3Toe Density, was measured at a point on the characteristic curve 0.3 LogE fast of the speed point (1.0 density). A lower 0.3Toe Density indicates higher contrast.

A measure of high intensity reciprocity failure (HIRF) is given by the difference in the speed of a 0.0001 second and 0.01 second exposure of equal light intensity, using the above procedures.

TABLE III

| | Gel | (i) | (ii) | (iii) | | Spd. | Contrast @ a density of | | |
|---|---|---|---|---|---|---|---|---|---|
| Emul. | type | Os | Ru | Ir | RLS | HIRF | 0.6 | 1.0 | 2.0 |
| A | N/Ox | — | — | — | 185 | −51 | 2.54 | 3.47 | 3.31 |
| B | " | x | — | — | 151 | −16 | 3.91 | 5.84 | 5.20 |
| C | " | — | x | — | 201 | −38 | 2.16 | 3.51 | 3.34 |
| D | " | x | x | — | 159 | −37 | 5.05 | 7.29 | 5.06 |
| E | " | — | — | x | 167 | 0 | 2.44 | 4.12 | 3.77 |
| F | " | x | — | x | 140 | −10 | 3.88 | 5.34 | 4.18 |
| G | " | — | x | x | 168 | −12 | 2.43 | 3.24 | 2.76 |
| H | " | x | x | x | 143 | −5 | 4.23 | 5.64 | 3.34 |
| I | Ox* | — | — | — | 168 | −17 | 1.70 | 2.56 | 3.48 |
| J | " | x | — | — | 134 | −13 | 2.02 | 3.44 | 4.03 |
| K | " | — | x | — | 185 | −25 | 1.65 | 2.62 | 3.34 |
| L | " | x | x | — | 124 | −12 | 4.26 | 6.05 | 5.47 |
| M | " | — | — | x | 161 | −6 | 1.92 | 3.22 | 4.02 |
| N | " | x | — | x | 149 | −6 | 2.50 | 3.96 | 3.89 |
| O | " | — | x | x | 176 | −2 | 1.99 | 3.08 | 3.85 |
| P | " | x | x | x | 126 | −1 | 5.46 | 7.83 | 7.25 |

*Ox = oxidized gelatin

The results given in Table III above are organized to facilitate the analysis of the effects of iridium doping and oxidized gelatin on the synergistic contrast increasing effect of $Cs_2Os(NO)Cl_5$ and $K_4Ru(CN)_6$ codoping. The benefit of iridium doping in reducing reciprocity failure is evident in comparing HIRF of Emulsions A through D to Emulsions E through H, and Emulsions I through L to Emulsions M through P. Comparisons among Emulsions A through D illustrate the contrast synergy known in the prior art. Examination of the contrasts in the upper-scale (optical density of 2.0), however, reveals a limitation of the prior art, in that the contrast synergy is seen only in the lower and mid-scales (optical densities of 0.6 and 1.0; or Toe Density in Example 1 above or in McIntyre et al, cited above, but not in the upper scale. This is the region of the sensitometric curve which reproduces shadow densities in prints. Comparison of Emulsion D and H shows that the addition of iridium during the make when $Cs_2Os(NO)Cl_5$ and $K_4Ru(CN)_6$ are present greatly reduces the contrast, particularly in the upper-scale where contrast nearly matches the undoped emulsion. This, once more, is the dopant interference problem to be solved.

Comparisons among Emulsions I-L made in oxidized gelatin show, unexpectedly, that the contrast increasing synergy between $Cs_2Os(NO)Cl_5$ and $K_4Ru(CN)_6$ is extended into the upper scale to an optical density of 2.0. The predicted effect of the single dopants on contrast at 2.0 density (16% for osmium and −4% for ruthenium) is only a 12% increase, whereas the actual is, unexpectedly, a 57% increase. Comparison among Emulsions M through P shows a similar extension of the contrast synergy to the upper scale when iridium is also present. In addition, a direct comparison of Emulsion L to Emulsion P shows a dramatic increase in contrast when iridium is added to the make in the presence of osmium and ruthenium.

The invention has been described in detail with particular reference to preferred embodiments thereof, but it will be understood that variations and modifications can be effected within the spirit and scope of the invention.

What is claimed is:

1. A radiation-sensitive emulsion comprised of (1) silver halide grains (a) containing greater than 50 mole percent chloride, based on silver, (b) having greater than 50 percent of their surface area provided by (100) crystal faces, and (c) having a central portion accounting for from 95 to 98 percent of total silver and containing three dopants each selected to satisfy a different one of the following class requirements:

(i) a metal coordination complex containing a nitrosyl or thionitrosyl ligand in combination with a transition metal chosen from groups 5 to 10 inclusive of the periodic table of elements, (ii) a shallow electron trapping dopant, and (iii) an iridium coordination complex having ligands which are more electropositive than a cyano ligand, and (2) a gelatino-peptizer for the silver halide grains that contains less than 30 micromoles of methionine per gram.

2. A radiation-sensitive emulsion according to claim 1 wherein the silver halide grains contain at least 70 mole percent chloride, based on silver.

3. A radiation-sensitive emulsion according to claim 1 wherein the silver halide grains contain less than 5 mole percent iodide, based on silver.

4. A radiation-sensitive emulsion according to claim 3 wherein the silver halide grains contain less than 2 mole percent iodide, based on silver.

5. A radiation-sensitive emulsion according to claim 1 wherein the gelatino-peptizer contains less than 12 micromoles of methionine per gram.

6. A radiation-sensitive emulsion according to claim 5 wherein the gelatino-peptizer contains less than 5 micromoles of methionine per gram.

7. A radiation-sensitive emulsion according to claim 1 wherein the class (i) dopant is located entirely within the central portion of the grains and is present in a concentration of from $10^{-10}$ to $10^{-6}$ mole per mole of silver, the class (ii) dopant is located within the central portion of grains in an interior region surrounding at least 50 percent of the total silver forming the grains and is present in a concentration of from $10^{-8}$ to $10^{-3}$ mole per mole of silver, and the class (iii) dopant is located within the central portion of the grains in a sub-surface shell region surrounding at least 50 percent of the total silver forming the grains and is present in a concentration of from $10^{-9}$ to $10^{-5}$ mole per mole of silver.

8. A radiation-sensitive emulsion according to claim 7 wherein the class (i) dopant satisfies the formula:

$$[ML_4(NY)L']^n \quad (I)$$

wherein

M is a transition metal chosen from groups 5 to 10 inclusive of the periodic table of elements;

L' is L or (NY);

L is a bridging ligand, which can be independently selected in each occurrence, and is anionic in at least four occurrences;

Y is oxygen or sulfur; and n is zero, −1, −2 or −3;

the class (ii) dopant which satisfies the formula:

$$[ML_6]^n \quad (II)$$

wherein

M is a filled frontier orbital polyvalent metal ion;

$L_6$ represents bridging ligands which can be independently selected, provided that at least four of the ligands are anionic ligands, and at least one of the ligands is a cyano ligand or a ligand more electronegative than a cyano ligand n is the net charge; and the class (iii) dopant satisfies the formula:

$$[IrL_6]^n \quad (III)$$

wherein n is zero, −1, −2, −3 or −4 and $L_6$ represents six bridging ligands which can be independently selected, provided that at least four of the ligands are anionic ligands and each of the ligands is more electropositive than a cyano ligand.

9. A radiation-sensitive emulsion according to claim 8 wherein the class (i) dopant satisfies the formula:

$$[M'L''_5(NY)]^n \quad (Ia)$$

wherein

M' represents chromium, rhenium, ruthenium or osmium;

L" represents one or a combination of halide and cyano ligands or a combination of these ligands with an aquo ligand;

Y is oxygen or sulfur; and n is zero, −1, −2 or −3.

10. A radiation-sensitive emulsion according to claim 9 wherein M' represents ruthenium or osmium.

11. A radiation-sensitive emulsion according to claim 10 wherein the class (i) dopant is present in a concentration of from $10^{-9}$ to $10^{-7}$ mole per silver mole.

12. A radiation-sensitive emulsion according to claim 8 wherein the bridging ligands of the class (ii) dopant are at least as electronegative as cyano ligands.

13. A radiation-sensitive emulsion according to claim 12 wherein the class (ii) dopant is present in a concentration of from $10^{-6}$ to $5\times10^{-4}$ mole per silver mole.

14. A radiation-sensitive emulsion according to claim 8 wherein the (iii) dopant is an iridium coordination complex containing six halide ligands.

15. A radiation-sensitive emulsion according to claim 14 wherein the class (iii) dopant is present in a concentration from $10^{-7}$ to $10^{-9}$ mole per silver mole.

16. A radiation-sensitive emulsion according to claim 8 wherein the class (i) dopant is present in a central region accounting for at least 50 percent of each of the grains, the class (ii) dopant is present in an interior shell surrounding from 75 to 95 percent of the silver forming each of the grains, and the class (iii) dopant is present in an interior shell surrounding at least 85 percent of the silver forming each of the grains.

17. A radiation-sensitive emulsion according to claim 1 wherein the central portion accounts for from 95 to 97 percent of silver forming each of the grains.

18. A radiation-sensitive emulsion according to claim 17 wherein the central portion accounts for 95 percent of silver forming each of the grains.

* * * * *